US006657516B1

(12) United States Patent
Junker et al.

(10) Patent No.: US 6,657,516 B1
(45) Date of Patent: Dec. 2, 2003

(54) WIDEBAND $TE_{11}$ MODE COAXIAL TURNSTILE JUNCTION

(75) Inventors: Gregory P. Junker, El Segundo, CA (US); Vrage Minassian, Burbank, CA (US)

(73) Assignee: Northrop Grumman Corporation, Los Angeles, CA (US)

( * ) Notice: Subject to any disclaimer, the term of this patent is extended or adjusted under 35 U.S.C. 154(b) by 0 days.

(21) Appl. No.: 09/494,612

(22) Filed: Jan. 31, 2000

(51) Int. Cl.[7] ..... H01P 5/12
(52) U.S. Cl. ..... 333/125; 333/137
(58) Field of Search ..... 333/125, 126, 333/135, 137, 106, 107, 122, 208, 239, 248, 261

(56) References Cited

U.S. PATENT DOCUMENTS 4,052,724 A * 10/1977 Takeichi et al. ..... 343/786
5,617,108 A * 4/1997 Silinsky et al. ..... 343/786
5,818,396 A * 10/1998 Anderson et al. ..... 343/786
6,313,714 B1 * 11/2001 Junker et al. ..... 333/125

OTHER PUBLICATIONS

Hiroyuki Kumazawa et al., "Wide–Band Communication Satellite Antenna Using a Multifrequency Primary Horn", IEEE Transactions on Antennas and Propagation, May 1975, pps. 404–407.

* cited by examiner

*Primary Examiner*—Robert Pascal
*Assistant Examiner*—Dean Takaoka
(74) *Attorney, Agent, or Firm*—John A. Miller; Warn, Burgess & Hoffmann, P. C.

(57) ABSTRACT

A coaxial turnstile junction (10) for combining and directing both satellite uplink and downlink signals. The junction (10) includes a tapered section (30) to provide better impedance matching of the downlink signal between a waveguide structure (14) and a plurality of symmetrically disposed downlink waveguides (38–44). The junction (10) includes a first end (26) that is in signal communication with an antenna feed horn (12). The junction (10) includes a cylindrical outer wall (28) and a cylindrical inner wall (18) that are coaxial and define an outer chamber (22) and an inner chamber (24). The outer wall (28) extends into the tapered section (30) where the tapered section (30) contacts the inner wall (18) and closes the outer chamber (22). The waveguides (38–44) are positioned around the outer wall (16) and are in signal communication with the outer chamber (22) through openings in the tapered section (30). Irises (46–52) are provided at the connection between the downlink waveguide (38–44) and the outer chamber (22) for impedance matching purposes. Satellite downlink signals from the downlink waveguides (38–44) are sent to the feed horn (12) through the outer chamber (22). Satellite uplink signals received by the feed horn (12) are directed through the inner chamber (24) to receiver circuitry. The dimensions of the irises (46–52) and the flare angle of the tapered section (30) are selected and optimized so that the downlink signal propagating down the waveguides (38–44) is impedance matched to the downlink signal propagating through the outer chamber (22).

15 Claims, 2 Drawing Sheets

WIDEBAND $TE_{11}$ MODE COAXIAL TURNSTILE JUNCTION

BACKGROUND OF THE INVENTION

1. Field of the Invention

This invention relates generally to a junction for directing both satellite uplink and downlink signals, and, more particularly, to a coaxial turnstile junction for combining and directing satellite uplink and downlink signals where the junction has a taper in the wave launching section to provide impedance matching for waveguide irises.

2. Discussion of the Related Art

Various communications systems, such as certain cellular telephone systems, cable television systems, internet systems, military communications systems, etc., make use of satellites orbiting the Earth to transfer signals. A satellite uplink communications signal is transmitted to the satellite from one or more ground stations, and then retransmitted by the satellite to another satellite or to the Earth as a downlink communications signal to cover a desirable reception area depending on the particular use. The uplink and downlink signals are typically transmitted at different frequency bandwidths. For example, the uplink communications signal may be transmitted at 30 GHz and the downlink communications signal may be transmitted at 20 GHz.

The satellite is equipped with an antenna system including a configuration of antenna feeds that receive the uplink signals and transmit the downlink signals to the Earth. Typically, the antenna system includes one or more arrays of feed horns, where each feed horn array includes an antenna reflector for collecting and directing the signals. In order to reduce weight and conserve satellite real estate, some satellite communications systems use the same antenna system and array of feed horns to receive the uplink signals and transmit the downlink signals. Combining satellite uplink signal reception and downlink signal transmission functions for a particular coverage area using a reflector antenna system requires specialized feed systems capable of supporting dual frequencies and providing dual polarization, and thus requires specialized feed system components. Also, the downlink signal, transmitted at high power (60–100 W) at the downlink bandwidth (18.3 GHz–20.2 GHz), requires low losses due to the cost/efficiency of generating the power and heat generated when losses are present.

These specialized feed system components include signal junctions, such as coaxial turnstile junctions, known to those skilled in the art, used in combination with each feed horn to provide signal combining and isolation to separate the uplink and downlink signals. The current turnstile junctions are limited in their ability to provide suitable impedance matching between the downlink waveguide and the junction over the complete downlink frequency bandwidth. Thus, there is a need to provide a junction that has better impedance matching between the junction and the downlink waveguides. It is therefore an object of the present invention to provide an improved coaxial turnstile junction for this purpose.

SUMMARY OF THE INVENTION

In accordance with the teachings of the present invention, a coaxial turnstile junction is disclosed for combining and directing both satellite uplink and downlink signals, that includes a tapered section to provide an improved impedance matching for the downlink signal between the junction and the downlink waveguides. The junction includes a first end that is in signal communication with an antenna feed horn. The first end of the junction includes a cylindrical outer wall and a cylindrical inner wall that are coaxial and define an outer chamber and an inner chamber. The outer wall extends into the tapered section at a second end opposite the first end, where the tapered section contacts the inner wall and closes the outer chamber at that end. A plurality of symmetrically disposed waveguides are positioned around the outer wall and are in signal communication with the outer chamber through openings in the tapered section. Irises are provided at the connection between the downlink waveguides and the outer chamber for impedance matching purposes.

Satellite downlink signals propagate through the downlink waveguides to the feed horn through the outer chamber. Satellite uplink signals received by the feed horn are directed through the inner chamber and exit the second end to be sent to receiver circuitry. The dimensions of the irises and the flare angle of the tapered section are selected and optimized so that the downlink signal from the downlink waveguides is impedance matched to the outer chamber at the downlink frequencies.

Additional objects, features and advantages of the present invention will become apparent from the following description and appended claims, taken in conjunction with the accompanying drawings.

DETAILED DESCRIPTION OF THE PREFERRED EMBODIMENTS

The following discussion of the preferred embodiments directed to a coaxial turnstile junction for combining and directing satellite uplink and downlink signals in a satellite communications system is merely exemplary in nature, and is in no way intended to limit the invention or its applications or uses.

Figure 1:
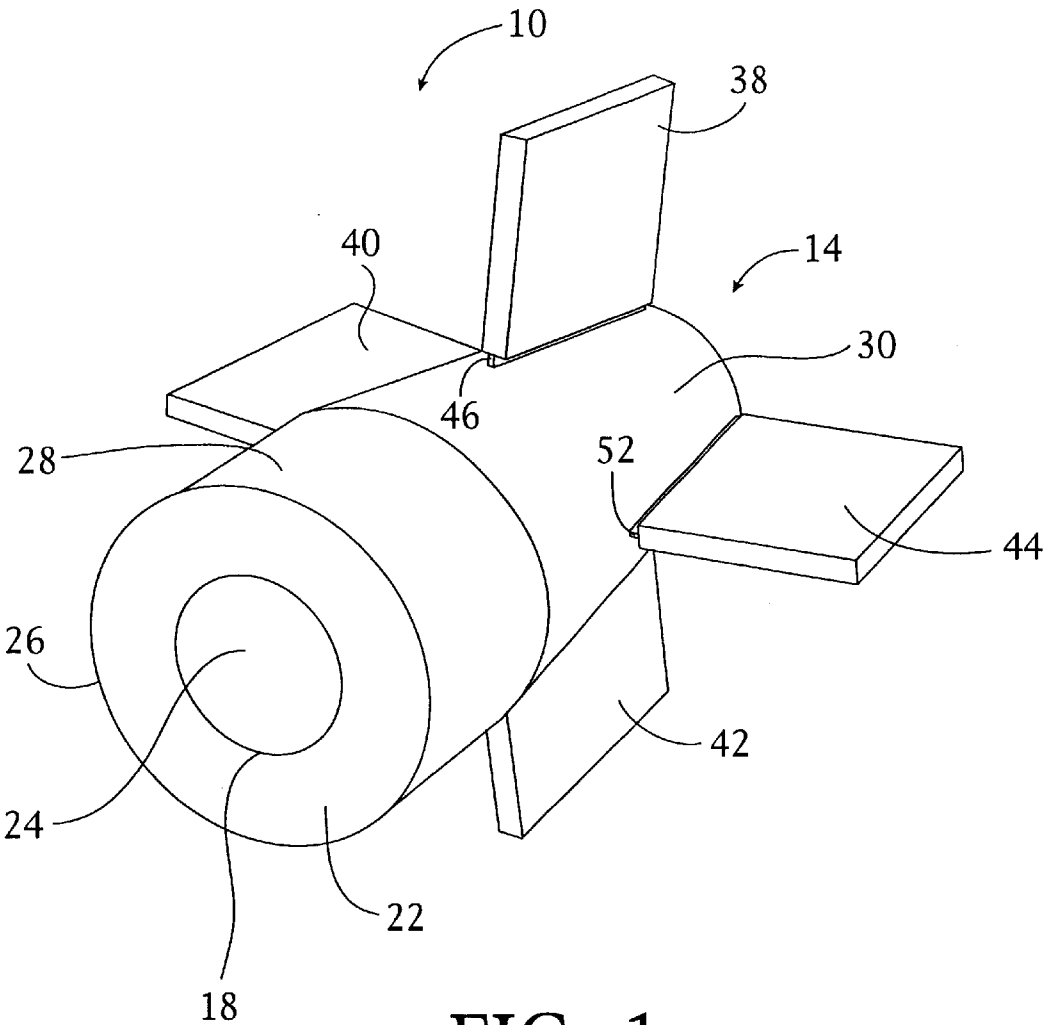
FIG. 1 is a perspective view of a coaxial turnstile junction, according to an embodiment of the present invention.
Figure 2:
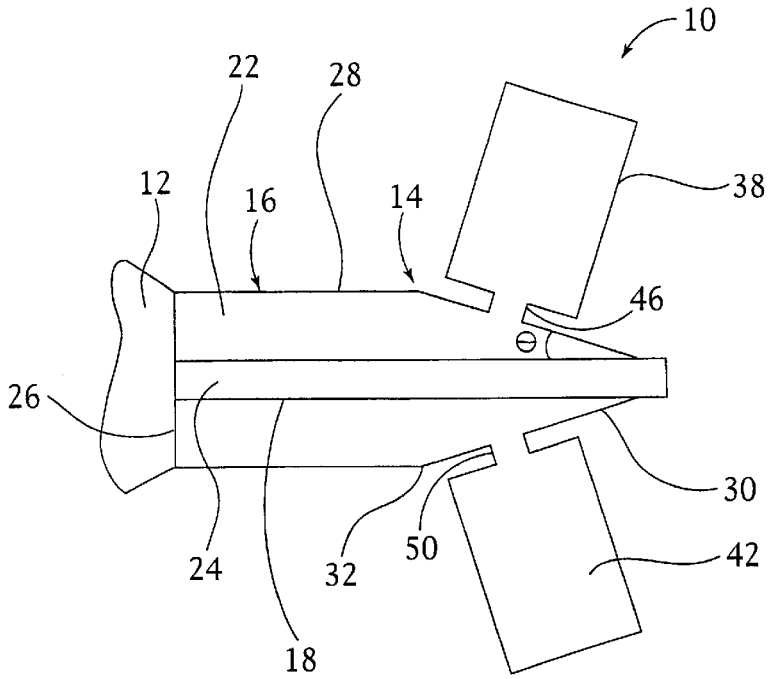
FIG. 2 is a cross-sectional view of the junction shown in FIG. 1 in a longitudinal direction.
Figure 3:
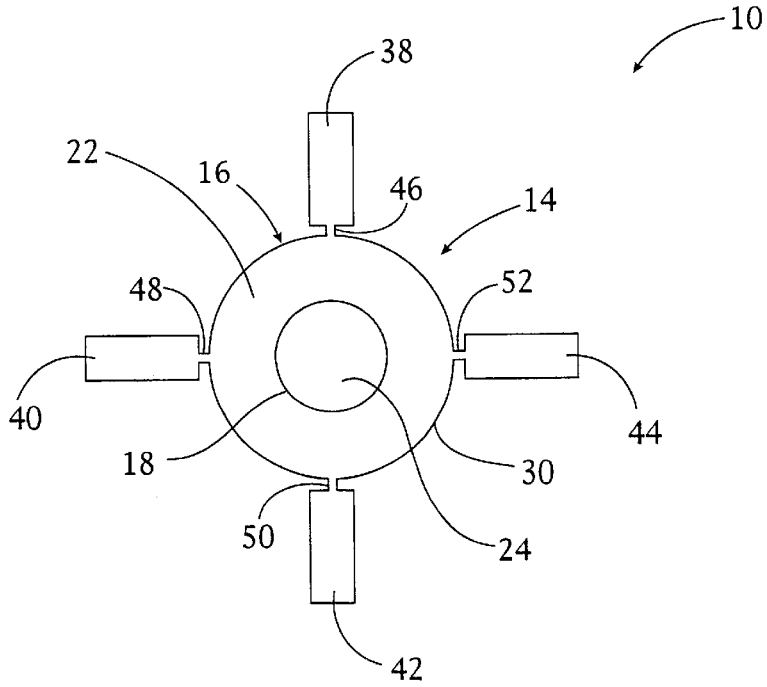
FIG. 3 is a cross-sectional view of the junction shown in FIG. 1 in a transverse direction.

FIGS. 1–3 show various views of a coaxial turnstile junction 10 that is part of a satellite antenna system, according to an embodiment of the present invention. As will be described below, the junction 10 is a waveguide device that directs the satellite uplink signals from an antenna feed horn 12 (only shown in FIG. 2) to receiver circuitry, and directs the satellite downlink signals from transmission circuitry to the feed horn 12. In one embodiment, the downlink signal is in the frequency range of 18.3 GHz–20.2 GHz, and the uplink signal is in the frequency range of 28–30 GHz. The dimensions of the junction 10 would be optimized for the particular frequency bands of interest. The antenna system on the satellite would employ several feed horns and associated junctions in a particular array, and may also employ a plurality of such arrays. Additionally, each array of feed horns may include a reflector system for collecting and directing the uplink and downlink signals. The feed horn 12 can have any dimensional shape suitable for the purposes described herein.

The junction 10 includes a waveguide structure 14 having an outer wall 16 and an inner wall 18 that define an outer waveguide chamber 22 and an inner waveguide chamber 24. The walls 16 and 18 can be made of any suitable conductive metal for the purposes described herein, such as aluminum or copper. The chambers 22 and 24 are in signal communication with the feed horn 12 at one end 26 of the structure 14. The inner wall 18 is cylindrical along the entire length of the structure 14. The outer wall 16 includes a cylindrical section 28 and a tapered conical section 30, where the cylindrical section 28 and the inner wall 16 are coaxial. The tapered section 30 extends from a rim 32 in the wall 16, and contacts the inner wall 18 so as to define a flare angle θ therebetween. Thus, the end of the chamber 22 opposite the feed horn 12 is closed. The outer wall 16 and the inner wall 18 may take on other geometrical shapes, such as rectangular, as long as the section 30 is tapered.

In this embodiment, four downlink waveguides 38–44 are symmetrically disposed around the tapered section 30. The waveguides 38–44 are in signal communication with the outer chamber 22 through impedance matching irises 46–52, respectively. It is important that the waveguides 38–44 be symmetrically disposed about the structure 14 for signal matching purposes. However, in alternate embodiments, a different number of waveguides can be provided, such as two waveguides, around the structure 14. In this embodiment, the waveguides 38–44 and the irises 46–52 are rectangular shaped, however, in alternate embodiments, the shape of these components may take on different configurations.

A satellite uplink signal received by the feed horn 12 is directed into the waveguide structure 14. The uplink signal that propagates through the inner chamber 24 is directed to a microwave network and to receiver circuitry (not shown) through the end of the structure 14 opposite the feed horn 12. The receiver circuitry may include a polarizer and an orthomode transducer, as would be well understood to those skilled in the art. In this embodiment, the internal chamber 24 is free space. In alternate embodiments, it may be necessary to change the dielectric constant of the internal chamber 24 for signal propagation purposes by providing a suitable dielectric therein. The uplink signal that enters the outer chamber 22 and propagates down the waveguides 38–44 is at the uplink frequency, and thus is filtered by the transmission circuitry.

The downlink signal to be directed by the feed horn 12 enters the waveguides 38–44 from suitable transmission circuitry (not shown), that may include phase matching networks and the like, as would also be well understood to those skilled in the art. Any impedance mismatch between the waveguides 38–44 and the waveguide structure 14 results in signal loss, thus providing loss of transmission energy. According to the invention, the tapered section 30 provides signal impedance matching and coupling for the signal propagating from the waveguides 38–44 into the outer chamber 22. The impedance of the signal at different locations along the length of the tapered section 30 varies depending on the dimensions of the waveguide 14 at that location, thus providing the ability to use this section as an impedance matching tool.

The impedance matching and coupling provided by the tapered section 30 is designed in combination with the irises 46–52 to provide the desired impedance matching at the particular downlink frequency band. For example, the width and length of the irises 46–52 and the location of the irises 46–52 along the tapered section 30 are optimized for the particular frequency. Likewise, the flare angle θ and the length of the tapered section 30 is also optimized in combination with the size and position of the irises 46–52. The waveguide structure 14 is designed to transmit the lowest fundamental ($TE_{11}$) mode. In one embodiment, for a downlink signal of about 30 GHz, θ is selected to be about 10°. One skilled in the art would know how to optimize these parameters for a particular frequency band.

The foregoing discussion discloses and describes merely exemplary embodiments of the present invention. One skilled in the art will readily recognize from such discussion and from the accompanying drawings and claims, that various changes, modifications and variations can be made therein without departing from the spirit and scope of the invention as defined in the following claims.

What is claimed is:

1. A signal junction for use in a communications system, said junction comprising:

a waveguide structure having a first end and a second end, said first end defining a signal port of the junction, said waveguide structure having an outer wall and an inner wall configured to define an outer chamber and an inner chamber, said inner wall and said outer wall being coaxial with each other proximate the first end, said outer wall including a tapered section proximate the second end so that the outer wall tapers towards the inner wall at the second end; and a signal waveguide being in signal communication with the outer chamber through an opening in the tapered section of the outer wall, wherein the inner chamber receives an inlet signal through the signal port and the outer chamber receives an outlet signal from the waveguide and emits the outlet signal through the signal port.

2. The junction according to claim 1 wherein the inner wall is cylindrical shaped from the first end to the second end, and the outer wall includes a cylindrical shaped section where the outer wall and the inner wall are coaxial, said tapered section being a conical shaped section.

3. The junction according to claim 1 wherein the tapered section contacts the inner wall at the second end to close off the outer chamber at the second end, said tapered section contacting the inner wall at a predetermined flare angle.

4. The junction according to claim 1 wherein the signal waveguide includes an iris at an end of the waveguide where the waveguide is attached to the tapered section of the outer wall, said iris having a narrower cross-section than the rest of the waveguide to provide impedance matching for the outlet signal propagating from the waveguide to the outer chamber.

5. The junction according to claim 4 wherein the signal waveguide and the iris are rectangular shaped in cross-section.

6. The junction according to claim 1 comprising four waveguides equally spaced around the tapered section of the outer wall.

7. The junction according to claim 1 wherein the junction is part of a satellite antenna system and the inlet signal is a satellite uplink signal and the outlet signal is a satellite downlink signal.

8. The junction according to claim 7 wherein the first end of the junction is attached to a feed horn.

9. A turnstile junction for use in a satellite communications system, said junction combining and isolating a satellite uplink signal and a satellite downlink signal, said junction comprising:

a waveguide structure having a first end and a second end, said first end defining a feed port of the junction, said waveguide structure having an outer wall and an inner wall configured to define an outer chamber and an inner chamber, said inner wall being a cylindrical shaped wall from the first end to the second end, said outer wall including a cylindrical shaped section at the first end so that the inner and outer walls are coaxial with each other at the first end, and including a conical shaped section proximate the second end such that the outer wall tapers towards the inner wall at the second end and contacts the inner wall, said conical section defining a predetermined flare angle with the inner wall; and a waveguide being in signal communication with the outer chamber through an opening in the conical section of the outer wall, wherein the inner chamber receives the satellite uplink signal through the feed port and the outer chamber receives the satellite downlink signal from the waveguide and emits the downlink signal through the feed port.

10. The junction according to claim 9 wherein the waveguide includes an iris at an end of the waveguide where the waveguide is attached to the outer wall, said iris having a narrower cross-section than the rest of the waveguide to provide impedance matching for the outlet signal propagating from the waveguide to the outer chamber.

11. The junction according to claim 10 wherein the waveguide and the iris are rectangular shaped in cross-section.

12. The junction according to claim 9 comprising four waveguides equally spaced around the outer wall, and wherein each of the waveguides includes an impedance matching iris.

13. The junction according to claim 9 wherein the first end of the junction is attached to a feed horn.

14. A turnstile junction for use in combination with a satellite antenna system, said junction combining and isolating a satellite uplink signal and satellite downlink signal having two different frequencies, said junction comprising:

an elongated structure having a first end and a second end, said first end defining a signal port of the junction, said signal port being attached to a feed horn, said elongated structure having an outer wall and an inner wall configured to define an outer chamber and an inner chamber, said inner wall being a cylindrical shaped wall from the first end to the second end, said outer wall including a cylindrical shaped section at the first end so that the inner and outer walls are coaxial with each other at the first end, and including a conical shaped section at the second end such that the outer wall tapers towards the inner wall at the second end and seals the outer chamber at the second end, said conical section defining a predetermined flare angle; and four rectangular waveguides being in signal communication with the outer chamber through openings in the conical section of the outer wall, said waveguides being equally spaced around the outer wall, each of the waveguides including an iris at an end of the waveguide where the waveguide is attached to the outer wall, said iris having a narrower cross-section than the rest of the waveguide to provide impedance matching for the outlet signal propagating from the waveguides to the outer chamber, wherein the inner chamber receives the uplink signal through the signal port and the outer chamber receives the downlink signal from the waveguides and emits the downlink signal through the signal port.

15. The junction according to claim 14 wherein the at least one waveguide and the iris are rectangular shaped in cross-section.

* * * * *